US006489287B1

(12) United States Patent
Gauthier et al.

(10) Patent No.: US 6,489,287 B1
(45) Date of Patent: Dec. 3, 2002

(54) DETERGENT FORMULATIONS COMPRISING AT LEAST ONE WATER SOLUBLE POLYMER, OR SALT THEREOF, BEARING A PHOSPHONATE GROUP

(75) Inventors: Francois Gauthier, Verneuil en Halatte (FR); Yves Duccini, Beauvais (FR); David Witiak, Yardley, PA (US); Barry Weinstein, Dresher, PA (US); Raymond Porter, Elkins Park, PA (US)

(73) Assignee: Rohm and Haas Company, Philadelphia, PA (US)

( * ) Notice: Subject to any disclaimer, the term of this patent is extended or adjusted under 35 U.S.C. 154(b) by 0 days.

(21) Appl. No.: 09/338,304

(22) Filed: Jun. 22, 1999

Related U.S. Application Data

(63) Continuation of application No. 09/063,448, filed on Apr. 21, 1998, now abandoned.

(30) Foreign Application Priority Data

May 9, 1997 (FR) ..... 97 05738

(51) Int. Cl.[7] ..... C11D 3/37; C11D 7/36; C11D 17/00

(52) U.S. Cl. ..... 510/476; 510/361; 510/434; 510/230; 510/533; 510/467; 510/436; 510/228

(58) Field of Search ..... 510/476, 361, 510/434, 230, 533, 467, 436, 228

(56) References Cited

U.S. PATENT DOCUMENTS

| | | | | |
|---|---|---|---|---|
| 2,957,931 A | * | 10/1960 | Hamilton et al. | 554/78 |
| 4,046,707 A | * | 9/1977 | Smith et al. | 252/180 |
| 4,681,686 A | * | 7/1987 | Richardson et al. | 210/699 |
| 5,077,361 A | * | 12/1991 | Hughes et al. | 526/233 |
| 5,216,099 A | * | 6/1993 | Hughes et al. | 526/318.2 |
| 5,294,686 A | * | 3/1994 | Flarman et al. | 526/233 |
| 5,294,687 A | * | 3/1994 | Blankenship et al. | 526/233 |
| 5,376,731 A | * | 12/1994 | Kerr et al | 525/340 |
| 5,866,664 A | * | 2/1999 | McCallum, III et al. | 526/233 |

FOREIGN PATENT DOCUMENTS

| | | | |
|---|---|---|---|
| DE | 643081 | | 8/1994 |
| EP | 0182411 | | 10/1985 |
| EP | 0 360 746 | * | 3/1990 |
| EP | 510831 | | 4/1992 |
| GB | 1290724 | | 10/1968 |

* cited by examiner

*Primary Examiner*—Yogendra N. Gupta
*Assistant Examiner*—Brian P. Mruk
(74) *Attorney, Agent, or Firm*—Stephen E. Johnson

(57) ABSTRACT

The invention provides a detergent formulations comprising at least one water soluble polymer, or salt thereof, bearing at least one phosphonate group. Suitable polymers comprise:

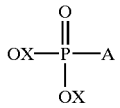

wherein X is H, Na, K or A; and A is a polymer, copolymer, or water soluble salt thereof, comprising, one or more of the following monomers in polymerized form:

carboxylic acids of the formula

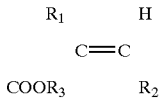

wherein $R_1$ is H, OH, $C_1$–$C_9$ alkyl or alkoxy or acetoxy or acetate $R_2$ is H, $C_1$–$C_3$ alkyl or alkoxy, $COOR_3$ $R_3$ is H, Na, K or $C_1$–$C_{10}$ alkyl;

hydroxypropyl acrylate, propyl methacrylate, 2-acrylamido-2-propane sulphonic acid, sodium styrene sulphonate, sodium allylsulphonate, sodium methyl sulphonate, vinyl sulphonic acid, and salts thereof; acrylamide, methacrylamide, tert-butylacrylamide, (meth)acrylonitrile, styrene, vinyl acetate allyloxy-2-hydroxypropyl sulphonate and dialkylacrylamide.

Machine dish washing detergents and laundry detergents are also provided which comprise detergent formulations of the present invention.

5 Claims, No Drawings

DETERGENT FORMULATIONS COMPRISING AT LEAST ONE WATER SOLUBLE POLYMER, OR SALT THEREOF, BEARING A PHOSPHONATE GROUP

This is a continuation of copending U.S. application Ser. No. 09/063,448, filed Apr. 21, 1998 and now abandoned. The latter copending application is hereby incorporated by reference.

The present invention relates to detergent formulations.

It is well known that in hard water areas magnesium and calcium ions cause unsightly deposits on surfaces, for example, on glassware, ceramic plates, fine china and plastic and other hard surfaces; this is especially marked when such items are washed in dish washing machines. Similar precipitation problems also occur in laundry washing, these cause the fabric to become stiff and rough to the touch and give coloured fabrics a faded appearance. Since before the mid 1960's, sodium tripolyphosphate (STPP) has been used in large quantities in most detergent formulations as a "builder"; that is an agent which is able to sequester positive cations such as magnesium and calcium in the washing solution and prevent them from depositing as salts (carbonate, silicate etc.) on the items being washed.

However, it is now known that the presence of phosphate, for example in the form of STPP, in lakes and rivers serves as a nutrient for algae growth and this results in a deterioration of water quality. These environmental concerns have lead to the voluntary reduction and, in some cases, a legislative ban on the use of STPP in detergent formulations. In consequence, phosphate-free alternatives have been developed. Typically, these phosphate-free systems are based on a combination of soda ash, citrate, silicates, perborates, enzymes or chlorine sources. Unfortunately, when removing or decreasing phosphate levels, the changes occurring in the end result of a washing process are more than those expected from the simple decrease in sequestration capacity of the detergent matrix. This stems from the multi-purpose capabilities of the STPP in the areas of emulsification of oily particles, stabilisation of solid soil suspension, peptisation of soil agglomerates, neutralisation of acid soils etc.; all key to obtaining an excellent wash end result. In an attempt to combat this problem, homopolymers and copolymers, for example, carboxylic acid polymers, are added to most of the commercial detergent formulations in current use. This is well documented in the prior art, see, for example, U.S. Pat. Nos. 4,711,740, 4,820,441, 5,552,078, 5,152,910, 4,046,707 and 5,160,630. However, since these polymers are non-biodegradable they must be used at low concentration which often imparts less than desirable protection against filming, on machine washed glassware and crockery, and encrustation and soil re-deposition on fabrics in laundry washing.

The problem addressed by the present invention, therefore, is to provide further detergent formulations which have good anti-filming performance characteristics when used in machine dishwashing detergents and good anti-encrustation and anti-deposition performance characteristics when used in laundry washing.

Accordingly, the present invention provides detergent formulations comprising at least one water soluble polymer or salt thereof bearing at least one phosphonate group. The invention also provides detergent formulations comprising at least one water soluble polymer comprising:

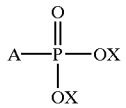

wherein X is H, Na, K or A; and A is a polymer, copolymer, or water soluble salt thereof, comprising, one or more of the following monomers in polymerised form:

carboxylic acids of the formula

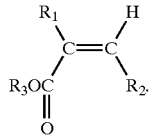

wherein $R_1$ is H, OH, $C_1$–$C_9$ alkyl or alkoxy or acetoxy or acetate $R_2$ is H, $C_1$–$C_3$ alkyl or alkoxy, $COOR_3$ $R_3$ is H, Na, K or $C_1$–$C_1$–$C_{10}$ alkyl;

hydroxypropyl acrylate, propyl methacrylate, 2-acrylamido-2-propane sulphonic acid, sodium styrene sulphonate, sodium allylsulphonate, sodium methyl sulphonate, vinyl sulphonic acid, and salts thereof; acrylamide, methacrylamide, tert-butylacrylamide, (meth)acrylonitrile, styrene, vinyl acetate allyloxy-2-hydroxypropyl sulphonate and dialkylacrylamide.

Machine dish washing detergents and laundry detergents are also provided which comprise detergent formulations of the present invention.

The detergent formulations containing polymers with phosphonate functional groups according to the invention show a surprising enhancement in the filming performance in machine dishwashing, anti-encrustation and anti-deposition performance in fabric laundering when compared to corresponding polymers without phosphonate functional groups. The detergent formulations according to the invention may be in powder, liquid, granular, pellet or tablet form, and may also contain up to 90% by weight of sodium carbonate.

The water-soluble polymers used in the present invention preferably have a weight average molecular weight below 20,000. Advantageously the weight average molecular weight is from 1,000 to 20,000, preferably from 1,000 to 10,000 and most preferably from 1,000 to 5,000.

The polymer used in the formulations of the present invention may comprise monoethylenically unsaturated ($C_3$–$C_7$) mono-carboxylic acids such as acrylic acid and methacrylic acid, and monoethylenically unsaturated ($C_4$–$C_8$) di-carboxylic acids such as maleic acid and itaconic acid.

The amount of polymeric builder present in the detergent formulations of the invention is typically 0.1% to 6% by weight of the detergent formulation. Some or all of the polymeric builder may be phosphonate containing polymers. Conveniently, the detergent formulations of the present invention may additionally comprise up to 90% by weight of the detergent formulation of a water soluble builder such as alkaline carbonate or bicarbonate salt, silicates and zeolites for example.

Any methods to prepare phosphonate containing polymers may be employed to make the polymers used in the present invention; see, for example, U.S. Pat. Nos. 4,046707, 5,376,731, 5,077,361 and 5,294,686.

The invention also provides for the use of polymers comprising:

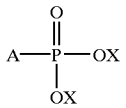

wherein X is H, Na, K or A; wherein A is a polymer, copolymer, or water soluble salt thereof, comprising, one or more of the following monomers in polymerised form:

carboxylic acids of the formula:

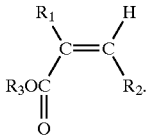

wherein:

$R_1$ is H, OH, $C_1$–$C_9$ alkyl or alkoxy or acetoxy or acetate;

$R_2$ is H, $C_1$–$C_3$ alkyl or alkoxy, $COOR_3$

R3 is H, Na, K or $C_1$–$C_{10}$ alkyl;

hydroxypropyl acrylate, propylmethacrylate, 2-acrylamido-2-propane sulphonic acid, sodium styrene sulphonate, sodium allylsulphonate, sodium methyl sulphonate, vinyl sulphonic acid, and salts thereof; acrylamide, methacrylamide, tert-butylacrylamide, (meth)acrylonitrile, styrene, vinyl acetate allyloxy-2-hydroxypropyl sulphonate and dialkylacrylamide, as some or all of the builder in detergent formulations.

The invention will now be further illustrated by the following Examples.

The anti-filming performance in dishwashing applications and the anti-encrustation and anti-soil deposition performance in laundry applications of polymers containing phosphonate groups was compared with that of similar polymers without the phosphonate groups using phosphate-free machine base formulations typical of those in current commercial use. The polymers were added to the base formulations at dosage levels of up to 6% by weight of the final detergent formulation (DF), as shown in Table I.

TABLE I

| | DF 1 | DF 2 | DF 3 | DF 4 | DF 5 |
|---|---|---|---|---|---|
| Sodium carbonate | 20% | 20% | 30% | 40% | 80% |
| Sodium disilicate | 10% | 10% | 7% | 0% | 0% |
| Sodium citrate dihydrate | 30% | 30% | 10% | 0% | |
| Sodium Sulphate | — | 9% | 2% | 50% | 10% |
| Sodium perborate | 8% | 8% | 7.5% | 0% | |
| Bleach each activator TAED | 2% | 2% | 2.5% | 0% | |
| Anionic surfactant | 0% | 0% | 0% | 6.7% | 6.7% |
| Non-ionic surfactant (Plurafac Non-ionic (LF-403) (ex BASF) | 1% | 1% | 3% | 3.3% | 3.3% |
| Enzyme (Savinase 6.0 T) (ex Novo Nordisk) | 1% | 1% | 2% | 0% | 0% |
| Polymer (dry weight) | 2% or 4% | 2% or 4% | 6% | 1.5% | 1.5% |
| Sodium bicarbonate | 26% or 24% | 17% or 15% | 20% | 0% | 0% |

The polymers investigated are shown in Table II

TABLE II

| Polymer | Structure | Mw |
|---|---|---|
| 1 | AA (comparative) | 4500 |
| 2 | AA (comparative) | 10000 |
| 3 | AA (comparative) | 2000 |
| 4 | AA (comparative) | 2000 |
| 5 | AA (comparative) | 2000 |
| 6 | AA/MAL 90/10 (comparative) | 3300 |
| 7 | AA/MAL 90/10 (comparative) | 2300 |
| 8 | 90AA/10EA (Comparative) | 2000 |
| 9 | AA-phosphonate (exp) | 3700 |
| 10 | AA-phosphonate (exp) | 1700 |
| 11 | AA/MAL 90/10-phosphonate (exp) | 2100 |
| 12 | AA/MAL 90/10-phosphonate (exp) | 3200 |
| 13 | AA/MAL 95/5-phosphonate (exp | 1810 |
| 14 | AA/MAL 90/10-phosphonate (exp) | 1810 |
| 15 | AA/MAL 85/15-phosphonate (exp) | 2040 |
| 16 | AA/MAL 80/20-phosphonate (exp) | 1810 |
| 17 | AA/MAL 75/25-phosphonate (exp) | 1950 |
| 18 | AA/MAL 70/30-phosphonate (exp) | 2000 |
| 19 | AA/MAL 50/50-phosphonate (exp) | 2070 |
| 20 | AA/AM 95/5-phosphonate (exp) | 2000 |
| 21 | AA/AM 90/10-phosphonate (exp) | 2000 |
| 22 | AA-phosphonate (exp) | 3100 |

Polymers 1–8 are comparative commercially available polymers
Polymers 9–22 are experimental examples of the invention
Mw = Weight average molecular weight
AA: Acrylic acid
MAL: Maleic acid
AM: Acrylamide
EA: Ethyl acrylate

EXAMPLE 1

Dishwashing Detergent Applications

The tests were carried out in dish washing machines using conventional procedures; the following conditions were used either:

(a)

Dishwashing machine: FAURE LVA 112

Water Hardness: 600 ppm as calcium carbonate (Ca/Mg=3:1)

Soil: 50 g margarine+50 g whole milk per cycle

Normal programme (65° C.)

Dishware: 6 glasses, 2 stainless steel dishes, 3 plates Cycles: 4 to 8

Ratings: the results were evaluated after 4 and 8 washing cycles and given a score from 0 to 4 to represent the degree of filming; 0 is a clean glass and 4 is a completely opaque glass; or (b)

Dishwashing machine: Whirlpool model G590

Water Hardness: 300 ppm as calcium carbonate (Ca/Mg=3.5:1)

No food soil

Normal programme (50° C.)

Dishware: 4 glasses (ceramic plates, stainless steel flatware, misc china as ballast)

Cycles: 5

| | | |
|---|---|---|
| Ratings: | 0.00 = No film | 2.00 = Intermediate |
| | 0.50 = Barely perceptible | 3.00 = Moderate |
| | 1.00 = Slight | 4.00 = Heavy |

The results are shown in Table III.

TABLE III

| Polymer | DF 1 Test conditions (a) 4 cycles | DF 1 Test conditions (a) 8 cycles | DF 2 Test conditions (a) 4 cycles | DF 2 Test conditions (a) 8 cycles | DF 3 Test conditions (b) 5 cycles |
|---|---|---|---|---|---|
| None | 2 | 4 | 1.5 | 3 | 4.0 |
| 1 (comp) 4% Dose level | 0 | 1 | 0 | 0.5 | — |
| 2 (comp) 4% Dose level | 0.25 | 1.75 | 0 | 0.75 | |
| 8 (comp) 4% Dose level | 0 | 1 | 0.5 | 0.75 | |
| 9 (exp) 4% Dose level | 0 | 0 | 0.25 | 0.25 | |
| 6 (comp) 6% Dose level | — | — | — | — | 1.0/1.1 |
| 11 (exp) 6% Dose level | — | — | — | — | 0.3/0.4 |
| 12 (exp) 6% Dose level | — | — | — | — | 0.9/1.0 |
| 1 (comp) 2% Dose level | 2 | 3.5 | 1 | 3 | — |
| 2 (comp) 2% Dose level | 2.25 | 4 | 2 | 4 | — |
| 8 (comp) 2% Dose level | 3.25 | 4 | 3 | 4 | — |
| 9 (exp) 2% Dose level | 0 | 1.5 | 0.25 | 4 | — |

The detergent formulations chosen are typical of those in current commercial use. It will be seen from Table III that the control formulations, with no polymer added, show high precipitation and filming. Detergent formulations 1 and 2 mimic the severe hardness conditions typically encountered in Europe and the results show that dramatic reduction in filming with only 2% of the experimental phosphonate group containing polymer compared to the control formulations or the performance of the comparative polymers. The results in Table III also illustrate that this enhanced performance continues at higher polymer levels and under varied application conditions.

EXAMPLE 2

Laundry Detergent Applications

All wash tests were carried out at 35° C. (95° F.) using the appropriate detergent formulation at 0.15 wt. % concentration.

For the Encrustation Tests 5 g of a black knit cotton fabric were washed and rinsed five (5) times in a 1 liter bath of the test solution using a Terg-o-tometer to agitate the solutions and fabric swatches. Water hardness was 300 ppm (as $CaCO_3$ and a Ca:Mg ratio of 2:1). Washing time was 12 minutes and rinse time 3 minutes. In this test, to show the effects of encrustation, it is important for the fabric to be added to the wash bath prior to the detergent addition. Washed swatches were air-dried overnight prior to evaluation. The fabric swatches were evaluated visually, the colour change was also recorded on a Hunter Lab Colorquest 45/°0° spectrophotometer using the L*a*b* colour scale, and the Whiteness Index calculated (ASTM method E-313). A two gram (2 g) piece cut from each swatch was also ashed at 800° C. for 6 hours to record the build-up of inorganic residues on the fabric.

In the Soil Re-deposition Tests (Based on ASTM Method D-4008)

The wash conditions were similar to those used for encrustation testing except that the swatches were subjected only to three (3) wash/rinse cycles and the water hardness was 200 ppm (as $CaCO_3$ and a Ca:Mg ratio of 2:1). Two (2) clean cotton swatches and two (2) clean 65/35 PE/cotton polyblend swatches were added to the bath followed by the detergent and 2.5 ml of a yellow clay/oil dispersion (0.848 g dry clay soil and 0.026 g oily soil).

Performance of the detergent is measured as the Percent (%) Retention of Whiteness Index:

$$\% \text{ Ret of WI} = \frac{\text{Whiteness Index After Testing} \times 100}{\text{Whiteness Index Before Testing}}$$

In these laundry applications all polymers are used at the level of 1.5 g polymer solids per 100 g of detergent, with the exception of the polymer concentration data shown in Table VI.

Encrustation Results for Experimental Polymer 10 as Compared with Commercially Available Polymers 3,4 and 5 in Detergent Formulation 4

Table IV shows the almost complete elimination of fabric encrustation using polymer 10 with the mid-level soda ash detergent formulation 4. This reduction in encrustation is seen both in the freedom from surface fibre discoloration (WI) and the low residual inorganic ash levels. Comparative polymers 3,4, and 5 represent typical acrylic acid homopolymers widely used in many countries to formulate powdered laundry detergents.

TABLE IV

Fabric Encrustation Results using Detergent Formulation 4

| Polymer | WI | Ash (%) |
|---|---|---|
| 3 (comp) | 6.3 | 5.2 |
| 4 (comp) | 6.0 | 4.7 |
| 5 (comp) | 6.1 | 4.2 |
| 10 (exp) | 3.2 | 0.6 |
| No Polymer | 8.3 | 6.1 |
| Cloth Blank | 3.3 | 0.2 |

WI = Whiteness Index; lower values better

Encrustation results using the high level soda ash detergent formulation 5, shown in Table V illustrate a similar reduction in both colour change and residual ash levels using polymer 10 when compared to the conventional polymers or the detergent without polymer addition. It is of interest and quite surprising to note that phosphonated compounds comprising 80–90 wt % acrylic acid/20–10 wt% maleic acid perform substantially better than phosphonated acrylic acid/maleic acid copolymers with different AA/MAL weight ratios.

TABLE V

Fabric Encrustation Results using Detergent Formulation 5

| Polymer | WI | Ash (%) |
|---|---|---|
| 3 (comp) | 5.2 | 4.8 |
| 4 (comp) | 4.0 | 3.2 |
| 5 (comp) | 4.1 | 2.8 |
| 10 (exp) | 3.0 | 0.6 |
| 13 (exp) | 6.2 | 2.2 |
| 14 (exp) | 4.2 | 0.8 |
| 15 (exp) | 4.2 | 0.8 |
| 16 (exp) | 4.0 | 0.7 |
| 17 (exp) | 4.9 | 1.7 |
| 18 (exp) | 5.7 | 3.4 |
| 19 (exp) | 6.8 | 6.0 |
| No Polymer | 8.7 | 5.1 |
| Cloth Blank | 3.3 | 0.2 |

WI = Whiteness Index; lower values better

Encrustation Results for Exp. Polymer 11 as Compared with Commercially Available Polymer 6

Comparison between experimental polymer 11 and comparative polymer 6 illustrates the marked reduction in fabric encrustation when using the phosphonate terminated experimental co-polymers. Table VI illustrates the exceptional protection from discoloration afforded by Experimental polymer 11 even at abnormally low use concentrations. Table VI also shows that at experimental polymer use levels of 1%, or higher, eutrophication causing phosphate additives, such as sodium tri-poly phosphate (STPP), provide no additional encrustation protection beyond that contributed by the polymer itself.

TABLE VI

Fabric Encrustation with Co-polymers of Acrylic Acid and Maleic Acid in the High Level Soda Ash Detergent Formulation 5.

| | | Whiteness Index | | Ash | | |
|---|---|---|---|---|---|---|
| STPP (%) | Polymer Solids (%) | Polymer 6 (comp) | Polymer 11 (exp) | Polymer 6 (comp) | Polymer 11 (exp) | P in bath (ppm) |
| — | 0.75 | 6.6 | 3.3 | 6.2 | 1.2 | 0.42 |
| — | 1 | 6.5 | 3.3 | 6.0 | 0.6 | 0.56 |
| — | 1.5 | 6.1 | 3.3 | 5.8 | 0.7 | 0.84 |
| 1 | 0 | 3.5 | | 0.6 | | 4.93 |
| 1.3 | 0.75 | 3.3 | 3.3 | 0.5 | 0.5 | 5.35 |
| 1.3 | 1 | 3.2 | 3.2 | 0.5 | 0.5 | 5.49 |
| 1.3 | 1.5 | 3.2 | 3.2 | 0.5 | 0.6 | 5.77 |

Whiteness Index: Lower values better
P = Phosphorous (P) in the wash bath in ppm Encrustation Results For Exp Polymers 10–12, 20, 21 and 22 as Compared With Commercially Available Polymers 6 and 7

The high level soda ash detergent, formulation 5, is again used to illustrate the influence of composition, process, and molecular weight on fabric encrustation control.

It will be noted in Table VII that with the conventional process, Comparative polymers 6 and 7, the fabric surface discoloration and ash level increase as the molecular weight decreases. The established art expects this influence of molecular weight on fabric encrustation control. Unexpectedly, experimental polymers 10, 11, 12, and 22 show that, with the phosphonate terminated process, the surface colour protection is improved and the ash level is markedly reduced when the molecular weight is reduced. Table VII also illustrates the influence of co-monomer on fabric encrustation using comparable processes and molecular weight ranges.

TABLE VII

Fabric Encrustation with Detergent Formulation 5 and Various Co-polymers

| | WI | Ash (%) |
|---|---|---|
| No Polymer (control) | 8.3 | 5.5 |
| 7 (comparative) | 6.5 | 6.0 |
| 6 (comparative) | 5.4 | 5.0 |
| STPP (no polymer) | 3.5 | 0.6 |
| 12 (exp) | 4.5 | 3.3 |
| 11 (exp) | 3.4 | 0.8 |
| 22 (exp) | 4.4 | 2.9 |
| 10 (exp) | 3.6 | 2.2 |
| 21 (exp) | 3.8 | 2.1 |
| 20 (exp) | 3.7 | 2.4 |
| Cloth Blank | 3.3 | 0.2 |

The dispersant properties of the polymers shown above are illustrated in Table VIII using the soil re-deposition test described above:

TABLE VIII

Soil Re-deposition Performance with Detergent Formulation 5 and Various Co-polymers

| | % Ret of WI | |
|---|---|---|
| | Blend | Cotton |
| No Polymer (control) | 70 | 45 |
| 7 (comparative) | 96 | 85 |
| 6 (comparative) | 90 | 85 |
| STPP | 94 | 89 |
| 12 (exp) | 96 | 84 |
| 11 (exp) | 98 | 94 |
| 22 (exp) | 91 | 87 |
| 10 (exp) | 91 | 90 |
| 21 (exp) | 92 | 86 |
| 20 (exp) | 91 | 88 |
| Cloth Blank | 100 | 100 |

% Ret of WI = Percent retention of whiteness index; high values better

Again it is seen that composition, process, and molecular weight all influence the ability of the polymers to keep soil suspended in the wash bath and to prevent soil re-deposition on the washed fabric. Also, again, contrary to the commercially available polymers, the lower molecular weight Experimental polymers 10 and 11 illustrate a superior ability to protect the fabric from soil deposition compared to the higher molecular weight to Experimental polymers 12 and 22, and Comparative polymers 6 and 7.

We claim:

1. Detergent formulation comprising one or more water soluble phosphorus-containing polymer(s) wherein said one or more phosphorus-containing

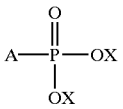

polymer(s) consists of wherein X is H, Na, K or A; A is a copolymer or a water soluble copolymer salt comprising 90–70 wt % of one or more of ($C_3$–$C_7$) monocarboxylic acids, selected from the group consisting of acrylic acid and methacrylic acid, and 10–30 wt % of one or more ($C_3$–$C_8$) dicarboxylic acids selected from the group consisting of maleic and itaconic acid; and wherein the weight average molecular weight of the phosphorus-containing polymer is below 20,000.

2. Detergent formulation according to claim 1 wherein the weight average molecular weight of the phosphorus-containing polymer is from 1000 to 5,000.

3. Method of forming a machine dish washing detergent formulation comprising incorporating into said detergent formulation, as some or all of the builder, one or more water soluble phosphorus-containing polymer(s) consisting of:

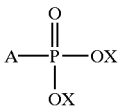

wherein X is H, Na, K or A; A is a copolymer or a water soluble copolymer salt comprising 90–70 wt % of one or more of ($C_3$–$C_7$) monocarboxylic acids, selected from the group consisting of acrylic acid and methacrylic acid, and 10–30 wt % of one or more ($C_4$–$C_8$) dicarboxylic acids selected from the group consisting of maleic and itaconic acid; and wherein the weight average molecular weight of the phosphorus-containing polymer is below 20,000; and wherein all of the phosphorus in said water soluble phosphorus-containing polymer(s) is in the form of one or more phosphonate groups.

4. Method of forming a laundry washing detergent formulation comprising the step of incorporating into said detergent formulation, as some or all of a builder, one or more water soluble phosphorus-containing polymer(s) consisting of:

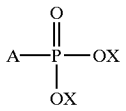

wherein X is H, Na, K or A; A is a copolymer or a water soluble copolymer salt comprising 90–70 wt % of one or more of (C3–$C_7$) monocarboxylic acids, selected from the group consisting of acrylic acid and methacrylic acid, and 10–30 wt % of one or more ($C_4$–$C_8$) dicarboxylic acids selected from the group consisting of maleic and itaconic acid; and wherein the weight average molecular weight of the phosphorus-containing polymer is below 20,000; and wherein all of the phosphorus in said water soluble phosphorus-containing polymer(s) is in the form of one or more phosphonate groups.

5. Method of forming a detergent formulation comprising the step of incorporating into said detergent formulation, as some or all of a builder, one or more water soluble phosphorus-containing polymers consisting of:

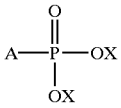

wherein X is H, Na, K or A; A is a copolymer, or a water soluble copolymer salt comprising 90–70 wt % of one or more of ($C_3$–$C_7$) monocarboxylic acids, selected from the group consisting of acrylic acid and methacrylic acid, and 10–30 wt % of one or more ($C_4$–$C_8$) dicarboxylic acid selected from the group consisting of maleic and itaconic acid; wherein the weight average molecular weight of the phosphorus-containing polymer is below 20,000; and wherein the detergent formulation is in liquid, powder, granular, pellet, or tablet form.

* * * * *